US009316142B2

(12) United States Patent
Inoue et al.

(10) Patent No.: US 9,316,142 B2
(45) Date of Patent: Apr. 19, 2016

(54) SPARK IGNITION ENGINE

(75) Inventors: Hiroshi Inoue, Sakai (JP); Masaharu Ohno, Sakai (JP); Yutaka Teruumi, Sakai (JP); Hiroyuki Tsuda, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 488 days.

(21) Appl. No.: 13/600,305

(22) Filed: Aug. 31, 2012

(65) Prior Publication Data

US 2013/0061834 A1 Mar. 14, 2013

(30) Foreign Application Priority Data

Sep. 8, 2011 (JP) ..... 2011-196073

(51) Int. Cl.
*F02B 1/02* (2006.01)
*F02P 13/00* (2006.01)

(52) U.S. Cl.
CPC .. *F02B 1/02* (2013.01); *F02P 13/00* (2013.01)

(58) Field of Classification Search
CPC ..... H01F 38/12; H01F 17/02; H01F 27/226; H01F 27/027; H01F 27/06; H01T 13/04–13/06; H01T 13/00; F02P 3/02; F02P 13/00; F02D 41/3005; F02D 2400/21–2400/22; F02B 1/04; F02B 1/02; F02F 7/006
USPC ..... 123/634, 635, 647, 620, 143 C, 195 R, 123/195 A, 195 C, 195 E, 195 P, 195 S, 198 E; 439/125, 126, 127; 336/67
See application file for complete search history.

(56) References Cited

U.S. PATENT DOCUMENTS

| | | | | | |
|---|---|---|---|---|---|
| 4,073,565 | A * | 2/1978 | Raymond | 439/777 |
| 4,669,443 | A * | 6/1987 | Oetting et al. | 123/647 |
| 4,777,925 | A * | 10/1988 | LaSota | 123/635 |
| 4,989,575 | A * | 2/1991 | Kanno | 123/635 |
| 5,003,958 | A * | 4/1991 | Yoneyama et al. | 123/635 |
| 5,094,219 | A * | 3/1992 | Koshida et al. | 123/635 |
| 5,618,193 | A * | 4/1997 | Nakajima et al. | 439/125 |
| 6,494,193 | B2 * | 12/2002 | Weingaertner et al. | 123/647 |
| 6,655,368 | B2 * | 12/2003 | Wada | 123/635 |
| 6,782,864 | B2 * | 8/2004 | Takagi et al. | 123/195 A |
| 6,868,844 | B2 * | 3/2005 | Kawai | 123/635 |
| 2003/0070665 | A1 * | 4/2003 | Paul et al. | 123/635 |
| 2010/0154760 | A1 * | 6/2010 | Iwanicki | 123/635 |
| 2010/0242932 | A1 * | 9/2010 | Nakano et al. | 123/635 |

FOREIGN PATENT DOCUMENTS

| | | |
|---|---|---|
| JP | H10-220331 A | 8/1998 |
| JP | 2002-048043 A | 2/2002 |
| JP | 2010-261342 A | 11/2010 |

* cited by examiner

*Primary Examiner* — Stephen K Cronin
*Assistant Examiner* — Susan E Scharpf
(74) *Attorney, Agent, or Firm* — Panitch Schwarze Belisario & Nadel LLP

(57) ABSTRACT

A spark ignition engine capable of fixing an ignition coil case even in a small engine includes an intake manifold 9 attached to a cylinder head 1, a coil case attachment stay 10 attached to the intake manifold 9, a cylinder portion through hole 12 formed on a board 11 of the coil case attachment stay 10, and a coil case attaching portion 13 provided in an upper part of the board 11. A flexible cylinder portion is caused to penetrate through a cylinder portion through hole, a tongue piece 15 is caused to protrude from a coil case peripheral wall 14 of an ignition coil case 7. The tongue piece 15 is mounted on the coil case attaching portion 13 and the coil case peripheral wall 14 is caused to abut on an edge portion 16 of the coil case attaching portion 13.

10 Claims, 5 Drawing Sheets

SPARK IGNITION ENGINE

BACKGROUND OF THE INVENTION

The present invention relates generally to a spark ignition engine and, more particularly, to a spark ignition engine capable of fixing an ignition coil case even in a small engine.

In some spark ignition engines, conventionally, a cylinder head cover is attached to a top surface of a cylinder head, a plug hole is formed on the top surface of the cylinder head at an outside of the cylinder head cover, a spark plug is fixed to an inner part of the plug hole, an ignition coil integral type plug cap is attached to the spark plug, the plug cap being formed by attaching a flexible cylinder portion to an ignition coil case, and a tip part of the flexible cylinder portion is inserted into the plug hole and is thus fitted in the spark plug (for example, see Japanese Unexamined Patent Publication No. 2010-255621 (FIG. 3)).

According to the engine of this type, it is possible to obtain an advantage that a distance from the ignition coil to the spark plug is reduced to minimize a voltage loss.

In the conventional technique, however, an attachment flange is fixed to the top surface of the cylinder head, a hole extension cylinder is formed on the attachment flange, the hole extension cylinder is caused to communicate with the plug hole, and the flexible cylinder portion is inserted into the plug hole through the hole extension cylinder so that the ignition coil case is fixed to the hole extension cylinder, which causes a problem.

In the small engine, the ignition coil case cannot be fixed. The attachment flange is fixed to the top surface of the cylinder head, the hole extension cylinder is formed on the attachment flange, the hole extension cylinder is caused to communicate with the plug hole, the flexible cylinder portion is inserted into the plug hole through the hole extension cylinder and the ignition coil case is fixed to the hole extension cylinder. Therefore it is necessary to fix the attachment flange to the top surface of the cylinder head. And in the small engine in which the cylinder head has no such space, the ignition coil case cannot be fixed.

BRIEF SUMMARY OF THE INVENTION

An objective of a preferred embodiment of the present invention is to provide a spark ignition engine which can fix an ignition coil case even in a small engine.

Specific matters according to a first preferred aspect of the present invention are as follows.

As is illustrated in FIG. 2, in a spark ignition engine, a cylinder head cover 3 is attached to a top surface 2 of a cylinder head 1, a plug hole 4 is formed on the top surface 2 of the cylinder head 1 at an outside of the cylinder head cover 3, a spark plug 5 is attached to an inner part of the plug hole 4, an ignition coil integral type plug cap 6 is attached to the spark plug 5, the plug cap 6 being formed by attaching a flexible cylinder portion 8 to an ignition coil case 7, and a tip part of the flexible cylinder portion 8 is inserted into the plug hole 4 and is thus fitted in the spark plug 5.

As is illustrated in FIGS. 1 and 2, an intake manifold 9 is attached to the cylinder head 1, a coil case attachment stay 10 is fixed to the intake manifold 9, a cylinder portion through hole 12 is formed on a board 11 of the coil case attachment stay 10, a coil case attaching portion 13 is provided in an upper part of the board 11, the flexible cylinder portion 8 is caused to penetrate through the cylinder portion through hole 12, and as is illustrated in FIG. 5C, a tongue piece 15 is caused to protrude from a coil case peripheral wall 14 of the ignition coil case 7, the tongue piece 15 is mounted on the coil case attaching portion 13, and the coil case peripheral wall 14 is caused to abut on an edge portion 16 of the coil case attaching portion 13 (coil case attaching portion edge portion 16) such that the tongue piece 15 is attached to the coil case attaching portion 13 with a coil case attaching screw tool 17 in a state in which the ignition coil case 7 is prevented from rotating by the coil case attaching portion edge portion 16, thereby fixing the ignition coil case 7 to the coil case attachment stay 10.

The first preferred aspect of the present invention produces the following effects.

It is possible to fix the ignition coil case even in the small engine.

As is illustrated in FIGS. 1 and 2, the intake manifold 9 is attached to the cylinder head 1, the coil case attachment stay 10 is fixed to the intake manifold 9, and the ignition coil case 7 is fixed to the coil case attachment stay 10. Therefore, it is possible to fix the ignition coil case 7, even in a small engine having no space for fixing an attachment flange or an attachment stay to the top surface 2 of the cylinder head 1.

It is possible to prevent damage from being caused by torsion of the flexible cylinder portion in the cylinder portion through hole.

As is illustrated in FIGS. 1, 2 and 5C, in a state in which the ignition coil case 7 is prevented from rotating by the coil case attaching portion edge portion 16, the tongue piece 15 is attached to the coil case attaching portion 13 with the coil case attaching screw tool 17, thereby fixing the ignition coil case 7 to the coil case attachment stay 10. Therefore, even if the coil case attaching screw tool 17 is screwed, the ignition coil case 7 and the flexible cylinder portion 8 are prevented from being turned together. Consequently, it is possible to prevent damage from being caused by the torsion of the flexible cylinder portion 8 in the cylinder portion through hole 12.

It is possible to suppress damage of the ignition coil caused by heat.

As is illustrated in FIGS. 1 and 2, the intake manifold 9 is attached to the cylinder head 1, the coil case attachment stay 10 is fixed to the intake manifold 9, and the ignition coil case 7 is fixed to the coil case attachment stay 10. Therefore, the heat of the cylinder head 1 is hardly transferred to the ignition coil case 7, and the ignition coil can be prevented from being damaged by the heat.

A second preferred aspect of the present invention produces the following effects in addition to the effects according to the first preferred aspect of the present invention.

It is possible to collectively attach a plurality of plug caps to the cylinder head.

As is illustrated in FIG. 1, a plurality of ignition coil cases 7, 7 and 7 are collectively fixed to the coil case attachment stay 10. A plurality of ignition coil integral type plug caps 6, 6 and 6 are assembled into the coil case attachment stay 10 in a subline, and the assembled product can be incorporated into the cylinder head 1 in a main line for an engine assembly. Therefore, the plurality of plug caps 6, 6 and 6 can be collectively attached to the cylinder head 1.

A third preferred aspect of the present invention produces the following effects in addition to the effects according to the first or second preferred aspect of the present invention.

It is possible to prevent rain water or washing water in car washing from entering the plug hole.

As is illustrated in FIG. 2, the flexible cylinder portion 8 of the plug cap 6 forms a bent shape by a straight spark plug approaching portion 18 and a straight ignition coil case approaching portion 19, and an elevation angle 19*a* of the ignition coil case approaching portion 19 with respect to the top surface 2 of the cylinder head 1 is made to be greater than an elevation angle 18*a* of the spark plug approaching portion 18 with respect to the top surface 2 of the cylinder head 1. Therefore, the ignition coil case approaching portion 19 is caused to take a vertical posture or the ignition coil case approaching portion 19 is caused to take a more vertical posture than the spark plug approaching portion 18. Therefore, the ignition coil case 7 and the coil case attachment stay 10 are disposed in positions close to a portion provided just above the plug hole 4 so that rain water or washing water in car washing can be prevented from entering the plug hole 4.

A fourth preferred aspect of the present invention produces the following effects in addition to the effects according to any of the first to third preferred aspects of the present invention.

It is possible to easily fabricate a coil case attachment stay.

As illustrated in FIGS. 2, 3 and 5B, the coil case attachment stay 10 is formed by a metal plate, attachment legs 22 and 22 are formed by leading pieces 21 and 21 which are led out from an intake manifold side board edge portion 20 on the intake manifold 9 side of the board 11, a leading piece 24 led out from a cylinder head side board edge portion 23 on the cylinder head 1 side of the board 11 is bent to form the coil case attaching portion 13, and the attachment legs 22 and 22 are fixed to the intake manifold 9 through stay attaching units 26 and 26. Therefore, it is possible to easily fabricate the coil case attachment stay 10 through stamping and bending for the metal plate.

A fifth preferred aspect of the present invention produces the following effects in addition to the effects according to any of the first to fourth preferred aspects of the present invention.

It is possible to carry out an attaching work or a maintenance work for a fuel injector or a fuel delivery pipe without being obstructed by a plug cap or an intake manifold.

As illustrated in FIGS. 2 and 3, a fuel injector 28 and a fuel delivery pipe 29 are attached to a peripheral wall of a branch tube 27 of the intake manifold 9, and the fuel injector 28 and the fuel delivery pipe 29 are disposed at an opposite side to the plug cap 6 with respect to the intake manifold 9. Therefore, it is possible to carry out an attaching work or a maintenance work for the fuel injector 28 or the fuel delivery pipe 29 without being obstructed by the plug cap 6 or the intake manifold 9.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 5A is a perspective view showing an ignition coil integral type plug cap, FIG. 5B is a perspective view showing a coil case attachment stay, and FIG. 5C is an enlarged view showing a portion seen in an arrow of VC in FIG. 1.

DETAILED DESCRIPTION OF THE INVENTION

Figure 1:
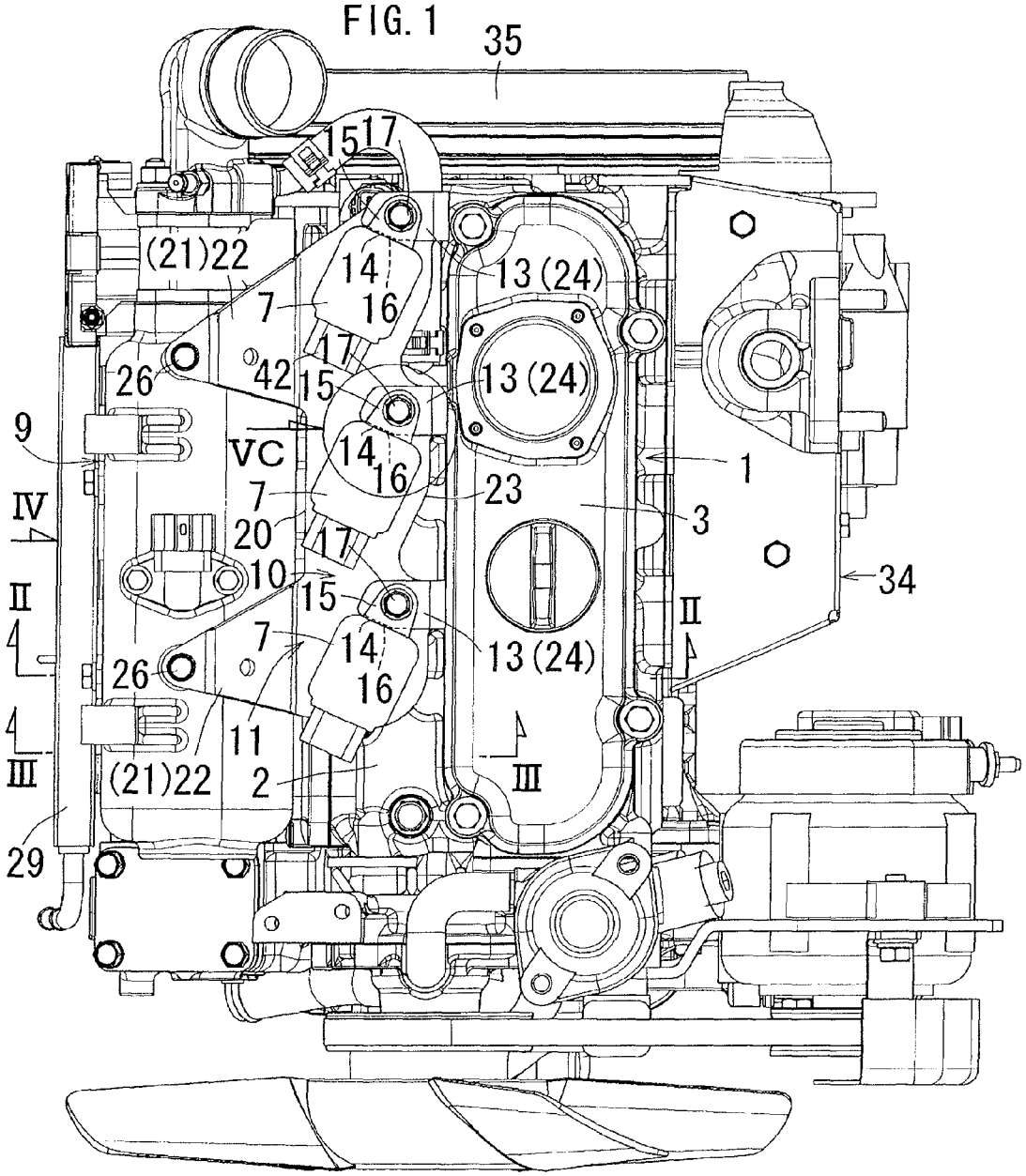
FIG. 1 is a plan view showing a spark ignition engine according to a preferred embodiment of the present invention.

Certain terminology is used in the following description for convenience only and is not limiting. The words "upper," "top," "front" and "rear" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout the several views, FIGS. 1-5C are views for describing a spark ignition engine according to a preferred embodiment of the present invention. In the preferred embodiment, description will be given to an electronic fuel injection type gasoline engine of a water cooling vertical in-line triple cylinder engine.

The outline of the engine is as follows.

Figure 2:
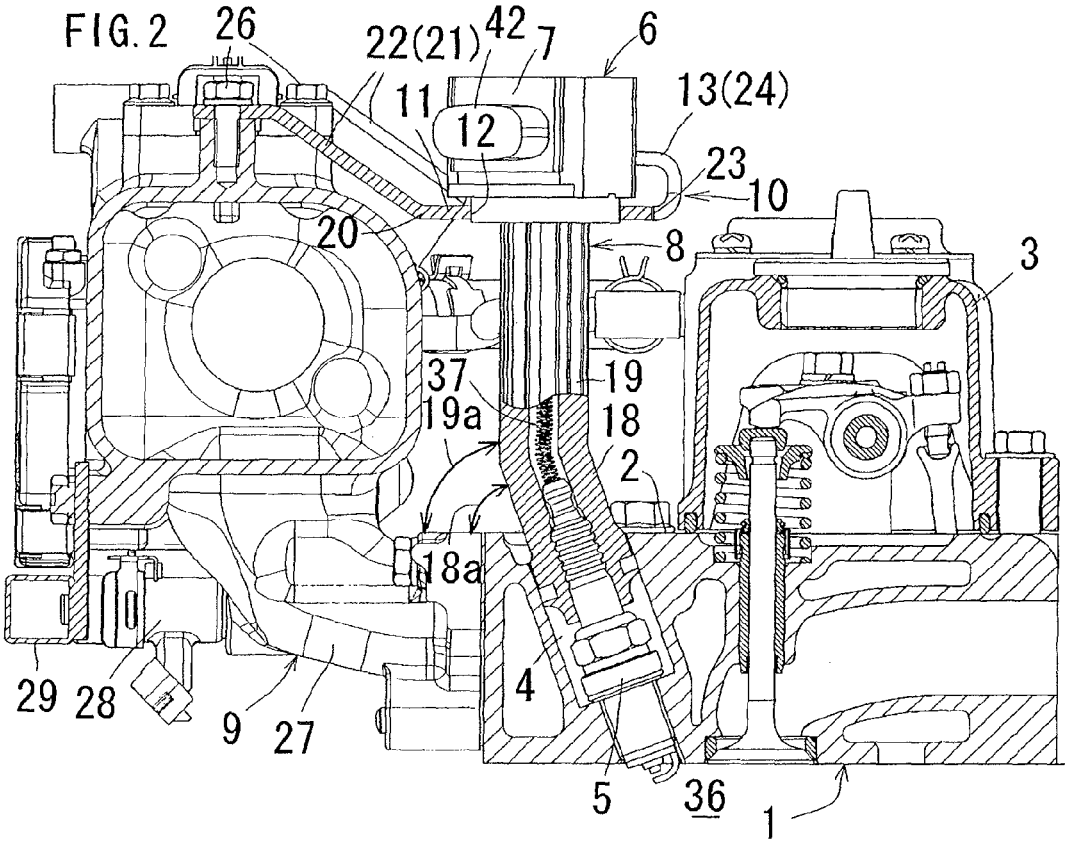
FIG. 2 is a sectional view taken along line II-II in FIG. 1.
Figure 4:
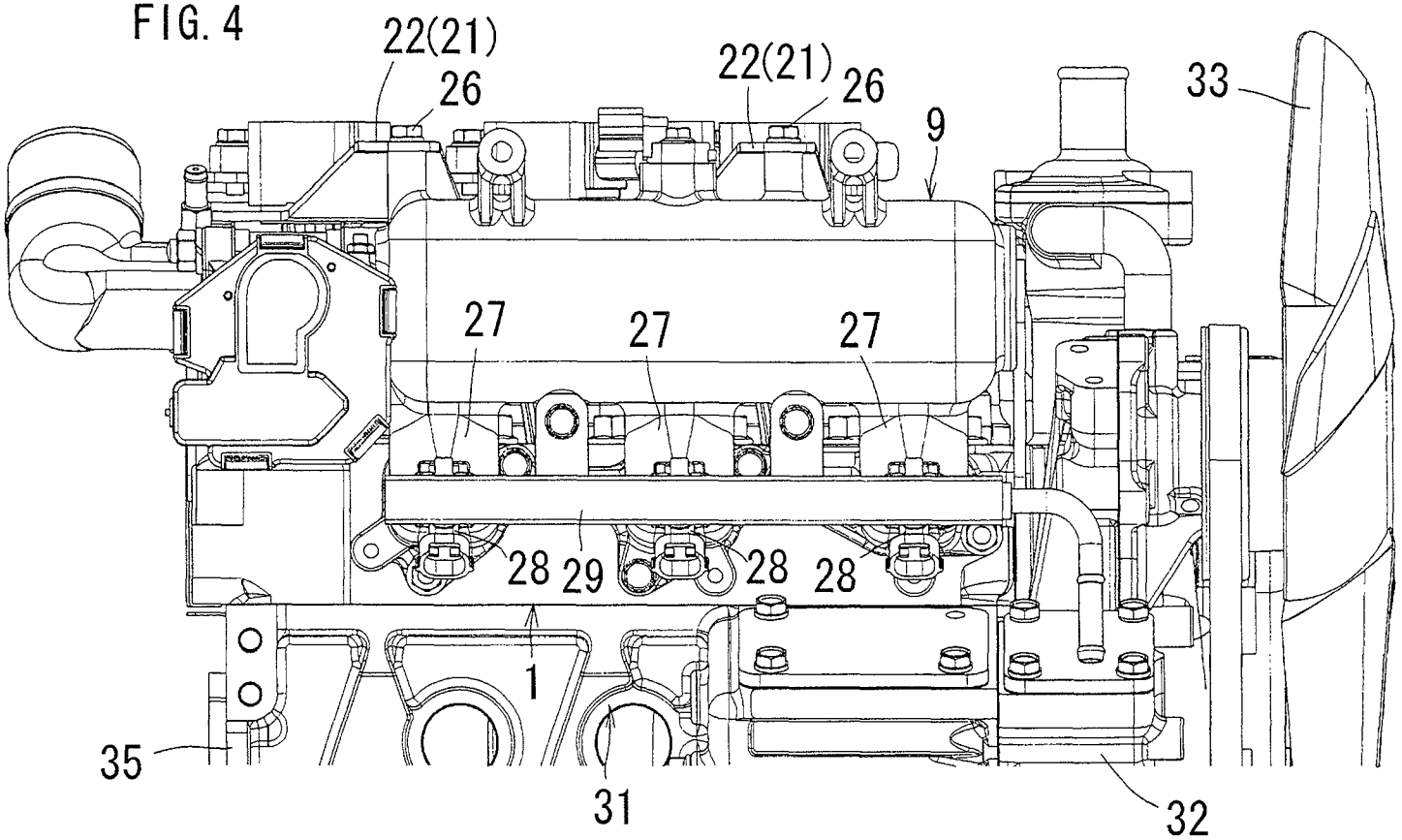
FIG. 4 is a view seen in a IV direction of FIG. 1.

As shown in FIG. 4, a cylinder head 1 is assembled into an upper part of a cylinder block 31, a timing transmission gear case 32 is assembled into a front part of the cylinder block 31, an engine cooling fan 33 is disposed in a front part of the timing transmission gear case 32, and a flywheel housing 35 is disposed in a rear part of the cylinder block 31. As shown in FIG. 2, a cylinder head cover 3 is assembled into an upper part of the cylinder head 1 and an intake manifold 9 is assembled into one of lateral sides of the cylinder head 1. Furthermore, as shown in FIG. 1, an exhaust manifold 34 is assembled into the other lateral side of the cylinder head 1.

As shown in FIG. 2, the cylinder head cover 3 is attached to a top surface 2 of the cylinder head 1, a plug hole 4 is formed on the top surface 2 of the cylinder head 1 at an outside of the cylinder head cover 3, a spark plug 5 is attached to an inner part of the plug hole 4, an ignition coil integral type plug cap 6 is attached to the spark plug 5, the plug cap 6 being formed by attaching a flexible cylinder portion 8 to an ignition coil case 7, and a tip part of the flexible cylinder portion 8 is inserted into the plug hole 4 and is thus fitted in the spark plug 5.

The plug hole 4 is inclined downward to approach a central part in a transverse direction of the cylinder head 1 as it becomes closer to a combustion chamber 36.

The flexible cylinder portion 8 is a rubber cylinder member which accommodates a spring 37 to be a relay member for electrically connecting a coil (not shown) in the ignition coil case 7 to the spark plug 5.

Figure 5A:
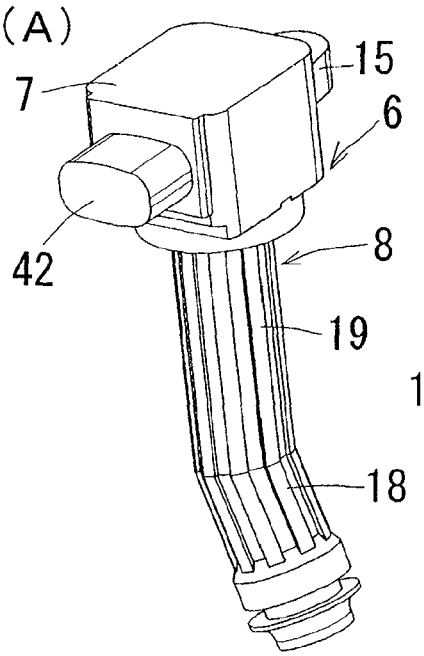
FIGS. 5A-5C are views for describing a component to be used in the preferred embodiment of the present invention, where
Figure 5C:
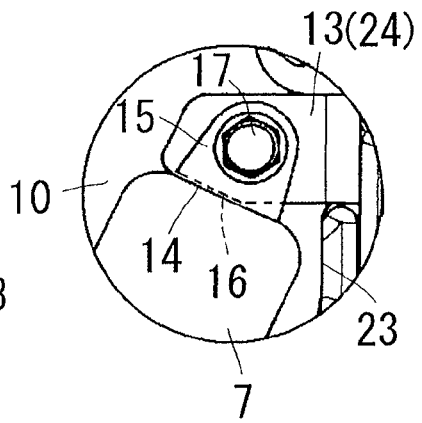

As shown in FIGS. 1 and 2, the intake manifold 9 is attached to the cylinder head 1, a coil case attachment stay 10 is fixed to the intake manifold 9, a cylinder portion through hole 12 is formed on a board 11 of the coil case attachment stay 10, a coil case attaching portion 13 is provided in an upper part of the board 11, and the flexible cylinder portion 8 is caused to penetrate through the cylinder portion through hole 12. As shown in FIG. 5C, a tongue piece 15 is caused to protrude from a coil case peripheral wall 14 of the ignition coil case 7, the tongue piece 15 is mounted on the coil case attaching portion 13, and the coil case peripheral wall 14 is caused to abut on an edge portion 16 of the coil case attaching portion 13 (coil case attaching portion edge portion 16). Consequently, in a state in which the ignition coil case 7 is prevented from rotating by the coil case attaching portion edge portion 16, the tongue piece 15 is fixed to the coil case attaching portion 13 with a coil case attaching screw tool 17, thereby fixing the ignition coil case 7 to the coil case attachment stay 10.

The coil case attaching portion edge portion 16 is formed linearly.

The coil case peripheral wall 14 of the ignition coil case 7 which is caused to abut on the coil case attaching portion edge portion 16 is formed in a flat shape. The ignition coil case 7 is a plastic box body. A connector 42 is disposed on an opposite side to the tongue piece 15 of the ignition coil case 7.

As shown in FIG. 1, a plurality of ignition coil cases 7, 7 and 7 are collectively fixed to the coil case attachment stay 10.

The number of the ignition coil cases 7 is three.

As shown in FIG. 2, the flexible cylinder portion 8 of the plug cap 6 forms a bent shape by a straight spark plug approaching portion 18 and a straight ignition coil case approaching portion 19 as seen from a front side, and an elevation angle 19*a* of the ignition coil case approaching portion 19 with respect to the top surface 2 of the cylinder head 1 is made to be greater than an elevation angle 18*a* of the spark plug approaching portion 18 with respect to the top surface 2 of the cylinder head 1. Consequently, the ignition coil case approaching portion 19 is caused to take a vertical posture or the ignition coil case approaching portion 19 is caused to take a more vertical posture than the spark plug approaching portion 18.

Figure 3:
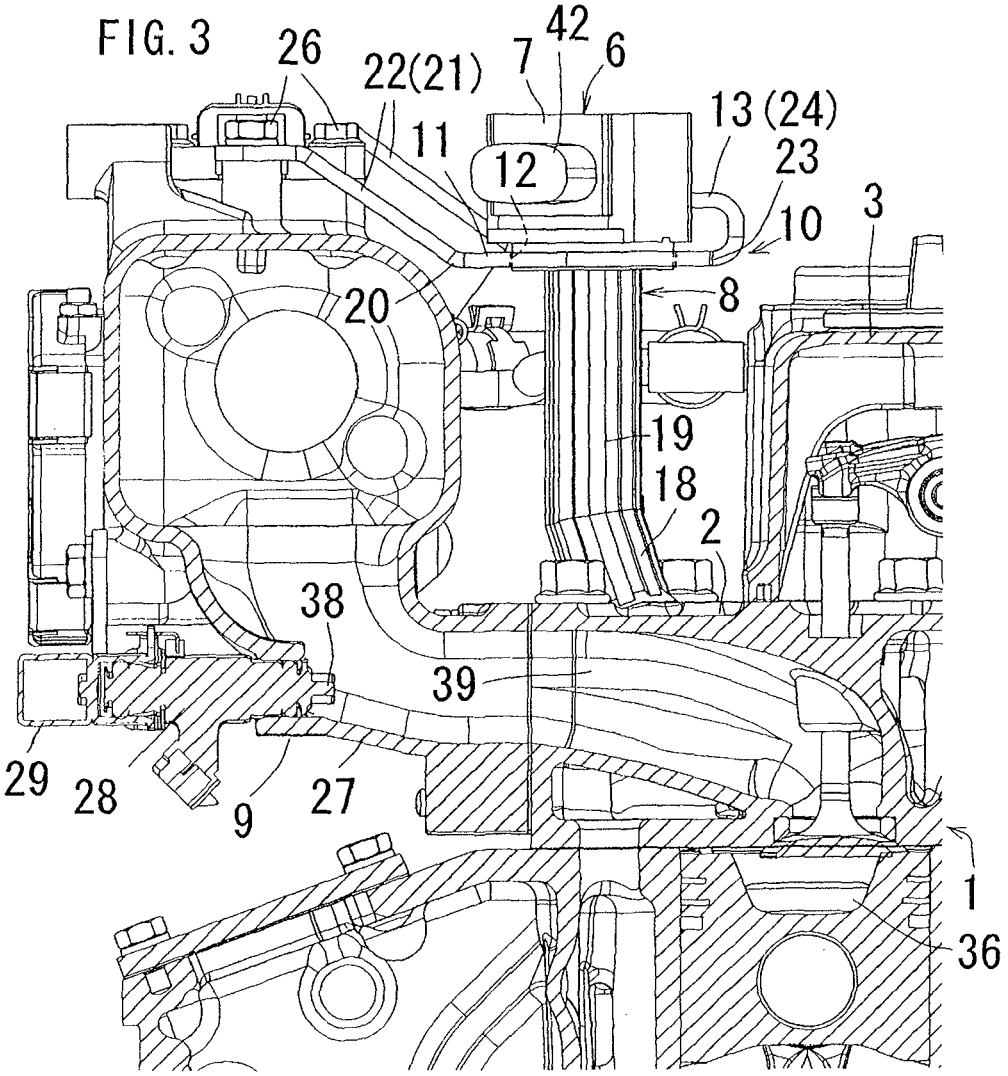
FIG. 3 is a sectional view taken along line III-III in FIG. 1.

As shown in FIGS. 2 and 3, the coil case attachment stay 10 is formed by a metal plate, attachment legs 22 and 22 are formed by leading pieces 21 and 21 which are led out from an intake manifold side board edge portion 20 on the intake manifold 9 side of the board 11, a leading piece 24 led out from a cylinder head side board edge portion 23 on the cylinder head 1 side of the board 11 is bent to form the coil case attaching portion 13, and the attachment legs 22 and 22 are fixed to the intake manifold 9 through stay attaching units 26 and 26.

Two attachment legs 22 and 22 are provided in the front-rear direction.

Figure 5B:
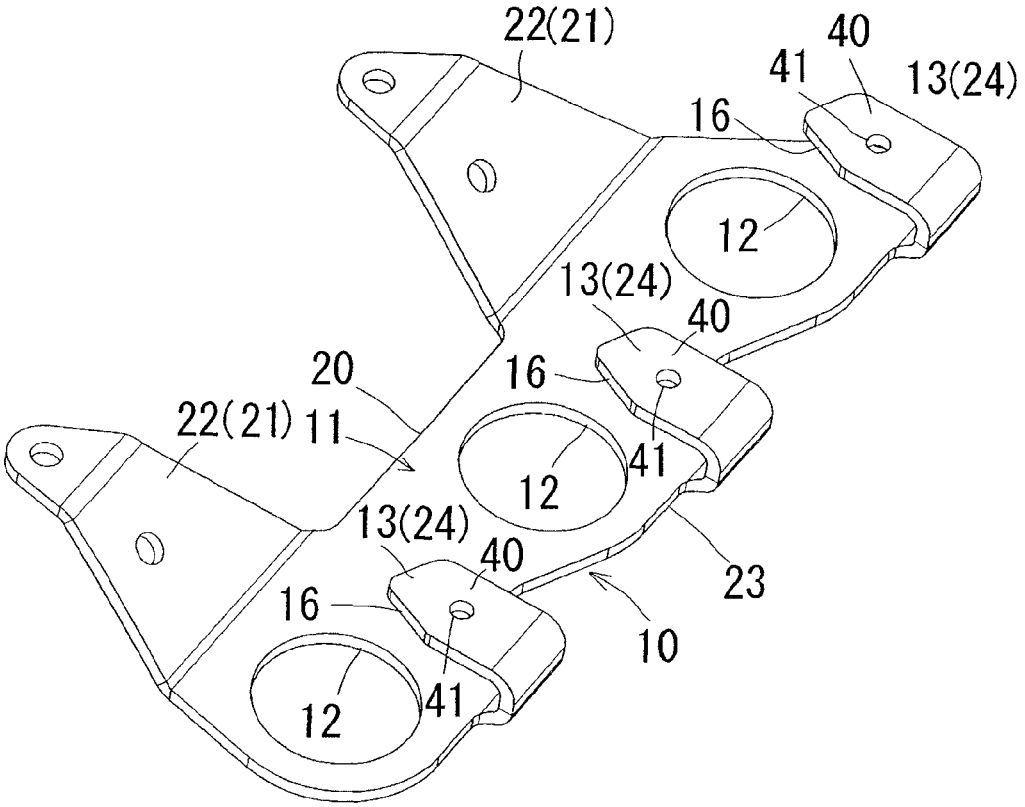

As shown in FIG. 5B, the coil case attaching portion 13 forms a folding piece 40 by bending, in a folding form, the leading piece 24 led out from the cylinder head side board edge portion 23, and a screw hole 41 is formed on the folding piece 40 to screw the coil case attaching screw tool 17 into the screw hole 41.

Three coil case attaching portions 13 are disposed in the front-rear direction.

The stay attaching unit 26 is a screw tool.

As shown in FIGS. 2 and 3, a fuel injector 28 and a fuel delivery pipe 29 are attached to a peripheral wall of a branch tube 27 of the intake manifold 9, and the fuel injector 28 and the fuel delivery pipe 29 are disposed at an opposite side to the plug cap 6 with respect to the intake manifold 9.

A nozzle 38 of the fuel injector 28 is turned into an inner part of an intake port 39 of the cylinder head 1 through an inner part of the branch tube 27 of the intake manifold 9.

The fuel delivery pipe 29 is extended in the front-rear direction.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A spark ignition engine comprising:

a cylinder head cover attached to a top surface of a cylinder head;

a plug hole formed on the top surface of the cylinder head outside of the cylinder head cover;

a spark plug attached to an inner part of the plug hole;

an ignition coil case having a coil case peripheral wall;

an ignition coil integral type plug cap attached to the spark plug, the plug cap being formed by attaching a flexible cylinder portion to an ignition coil case, with a tip part of the flexible cylinder portion being inserted into the plug hole and thus fitted in the spark plug, an intake manifold attached to the cylinder head, a coil case attachment stay directly fixed to the intake manifold and including a board, a cylinder portion through hole formed in the board, the flexible cylinder portion penetrating through the through hole, and an upper part of the board defining a coil case attaching portion, and a tongue piece protruding from the coil case peripheral wall, and mounted on the coil case attaching portion, wherein the coil case peripheral wall abuts a coil case attaching portion edge portion such that the tongue piece is directly attached to the coil case attaching portion with a coil case attaching screw tool in a state in which the ignition coil case is prevented from rotating by the coil case attaching portion edge portion, thereby fixing the ignition coil case to the coil case attachment stay.

2. The spark ignition engine according to claim 1, wherein a plurality of ignition coil cases are collectively fixed to the coil case attachment stay.

3. The spark ignition engine according to claim 1, wherein the flexible cylinder portion of the plug cap forms a bent shape by a straight spark plug approaching portion and a straight ignition coil case approaching portion, and an elevation angle of the ignition coil case approaching portion with respect to the top surface of the cylinder head is greater than an elevation angle of the spark plug approaching portion with respect to the top surface of the cylinder head such that the ignition coil case approaching portion takes a vertical posture or the ignition coil case approaching portion takes a more upright posture than the spark plug approaching portion when seen from a front part of a cylinder block, a flywheel housing being disposed in a rear part thereof.

4. The spark ignition engine according to claim 1, wherein the coil case attachment stay is formed by a metal plate, attachment legs are formed by leading pieces which are led out from an intake manifold side board edge portion, a leading piece led out from a cylinder head side board edge portion is bent to form the coil case attaching portion, and the attachment legs are fixed to the intake manifold through stay attaching units.

5. The spark ignition engine according to claim 1, wherein a fuel injector and a fuel delivery pipe are attached to a peripheral wall of a branch tube of the intake manifold, the fuel injector and the fuel delivery pipe being disposed at an opposite side to the plug cap with respect to the intake manifold.

6. A spark ignition engine comprising:

a cylinder head cover attached to a top surface of a cylinder head;

a plug hole formed on the top surface of the cylinder head outside of the cylinder head cover;

a spark plug attached to an inner part of the plug hole;

an ignition coil case having a coil case peripheral wall;

an ignition coil integral type plug cap attached to the spark plug, the plug cap being formed by attaching a flexible cylinder portion to an ignition coil case, with a tip part of the flexible cylinder portion being inserted into the plug hole and thus fitted in the spark plug, an intake manifold attached to the cylinder head, a coil case attachment stay fixed to the intake manifold and including a board, a cylinder portion through hole formed in the board, the flexible cylinder portion penetrating through the through hole, and an upper part of the board defining a coil case attaching portion, and a tongue piece protruding from the coil case peripheral wall, and mounted on the coil case attaching portion, wherein the coil case peripheral wall abuts a coil case attaching portion edge portion such that the tongue piece is attached to the coil case attaching portion with a coil case attaching screw tool in a state in which the ignition coil case is prevented from rotating by the coil case attaching portion edge portion, thereby fixing the ignition coil case to the coil case attachment stay, and wherein a flexible cylinder portion insertion space, into which the flexible cylinder portion is inserted, is formed outside of the cylinder head cover, between the cylinder head cover and the intake manifold, the board of the coil case attachment stay being disposed at an upper part of the flexible cylinder portion insertion space above the plug hole, outside of the cylinder head cover, and the board of the coil case attachment stay being located obliquely above the cylinder head cover, when seen from a front part of a cylinder block, a flywheel housing being disposed in a rear part thereof.

7. The spark ignition engine according to claim 6, wherein a plurality of ignition coil cases are collectively fixed to the coil case attachment stay.

8. The spark ignition engine according to claim 6, wherein the flexible cylinder portion of the plug cap forms a bent shape by a straight spark plug approaching portion and a straight ignition coil case approaching portion, and an elevation angle of the ignition coil case approaching portion with respect to the top surface of the cylinder head is greater than an elevation angle of the spark plug approaching portion with respect to the top surface of the cylinder head such that the ignition coil case approaching portion takes a vertical posture or the ignition coil case approaching portion takes a more upright posture than the spark plug approaching portion, when seen from a front part of a cylinder block, a flywheel housing being disposed in a rear part thereof.

9. The spark ignition engine according to claim 6, wherein the coil case attachment stay is formed by a metal plate, attachment legs are formed by leading pieces which are led out from an intake manifold side board edge portion, a leading piece led out from a cylinder head side board edge portion is bent to form the coil case attaching portion, and the attachment legs are fixed to the intake manifold through stay attaching units.

10. The spark ignition engine according to claim 6, wherein a fuel injector and a fuel delivery pipe are attached to a peripheral wall of a branch tube of the intake manifold, the fuel injector and the fuel delivery pipe being disposed at an opposite side to the plug cap with respect to the intake manifold.

* * * * *